US005701644A

United States Patent [19]

Kaegi et al.

[11] Patent Number: 5,701,644

[45] Date of Patent: Dec. 30, 1997

[54] METHOD FOR PRODUCING SELF-CRIMPING POLYMER BI-COMPONENT FIBERS

[75] Inventors: Werner Kaegi, Domat/Ems; Werner Stibal, Trimmis; Gunther Schaech; Rainer Straub, both of Chur; Gerhard Schmidt, Domat/Ems, all of Switzerland

[73] Assignee: EMS-Inventa AG, Zürich, Switzerland

[21] Appl. No.: 642,960

[22] Filed: May 6, 1996

[30] Foreign Application Priority Data

May 11, 1995 [DE] Germany ..... 195 17 348.1

[51] Int. Cl.[6] ..... D02G 1/00; D01D 5/32; D01F 8/04; D06M 15/643

[52] U.S. Cl. ..... 28/220; 28/240; 28/247; 264/168; 264/172.14; 264/211.14; 264/210.5

[58] Field of Search ..... 28/220, 240, 247; 264/168, 210.8, DIG. 26, 172.14, 211.14, 210.5, 342 RE

[56] References Cited

U.S. PATENT DOCUMENTS

| | | | |
|---|---|---|---|
| 3,399,108 | 8/1968 | Olson | 264/168 |
| 3,861,133 | 1/1975 | Frankfort et al. | 264/168 |
| 4,189,338 | 2/1980 | Ejima et al. | 264/DIG. 26 |
| 4,217,321 | 8/1980 | Campbell | 264/172.14 |
| 4,301,102 | 11/1981 | Fernstrom et al. | 264/168 |
| 5,110,517 | 5/1992 | Lukhard et al. | 264/168 |

FOREIGN PATENT DOCUMENTS 1760755 12/1976 Germany .

OTHER PUBLICATIONS

B. von Falkai, "Synthesefasern", Verlag Chemie, Weinheim 1981, pp. 126,148, and 149. No Translation.

R. Bauer et al, "Chemiefaser–Lexikon", Deutscher Fachverlag GmbH, Frankfurt/Main, 1979, pp. 60–63. No Translation.

*Primary Examiner*—Andy Falik
*Attorney, Agent, or Firm*—Browdy and Neimark

[57] ABSTRACT

A method for self-crimping of S/S bi-component fibers on a fiber line includes the steps of main drawing, post-drawing on a cold drawing unit, water application in the tensed state and relaxation at the dryer inlet in the compact closed state, which results in fibers with a novel Ω-shaped crimping structure.

17 Claims, 3 Drawing Sheets

METHOD FOR PRODUCING SELF-CRIMPING POLYMER BI-COMPONENT FIBERS

FIELD OF INVENTION

The invention relates in particular to a novel method for producing self-crimping polymer bi-component fibers, as well as the bi-component fibers of a novel crimped shape which can be produced in accordance with this method, as well as their use.

BACKGROUND

Bi-component fibers of the type S/S (side-by-side) are mainly produced because of their self-crimping properties. Based on the creation of different shrinkages of the two polymeric fiber halves, it is possible to create three-dimensional crimping which, in comparison with mechanical stuffer crimping with a sawtooth- like bent shape, has the advantage of increased bulkiness, higher elasticity and resilience and softer feel. A pre-requisite for self-crimping is a certain crimping potential created by differences in shrinkage, shrinking power and module of elasticity of the two fiber halves. Furthermore, the crimping ability is maximal for a defined polymer combination if the two components are present with approximately equal cross-sectional areas, e.g. each semicircular in cross section.

However, it is not absolutely necessary for the two components, which should adhere to each other well in addition to the requirement for shrinkage differences, to be different polymers, because a shrinkage difference can also be caused by differences in orientation, crystallinity or relative viscosity. The latter possibilities, however, are connected with a reduced crimping potential, which makes the inducing of the crimping difficult. The problem with fibers with too small crimping potential is to get them to crimp evenly in spite of this. As described in DE 17 60 755 and its equivalent GB 1,219,154, it is necessary for accomplishing this to open the stretched fiber tow consisting of many individual fibrils by means of an air jet nozzle, so that each individual fibril can crimp freely and relaxedly, unhampered by its neighbors. The usual three- dimensional crimping is created by this arrangement.

However, with the present-day capacities of staple fiber drawing lines, blowing up the fiber tow into a voluminous and bulky structure leads to the difficulty that this crimped tow has hardly any space for passing through a normal dryer during final drying and heat setting and consequently the tow has a tendency to become snagged which makes reasonable production very difficult. But even with bi-component fibers which per-se have a higher crimping potential because of their composition from two different polymers, only three-dimensional, spiral-shaped self-crimping was known up to now which, in connection with crimping large fiber tows, i.e. those consisting of a multitude of individual fibers, points to similar problems as in the example mentioned.

SUMMARY OF THE INVENTION

It is therefore an object of the invention to provide a novel method which avoids the above mentioned problems of the prior art and the described disadvantages, so that self-crimping of polymer bi-component fibers can also be controlled in large tow thicknesses on a fiber-line.

This and other objects according to the present invention are attained by means of (1) post-drawing of the hot and dry tow on the last, cold drawing unit, following the main drawing; (2) in the tensed state and with optional squeezing, the tow is provided with a water coating of between 10 and 30 weight %, measured prior to relaxation; and (3) relaxation is performed in the compact, closed state at the inlet of a dryer.

In what follows, a tow is understood to be a structure of at least 5000 endless fibers. PA is short for polyamide (nylon); PET for the polyester, polyethylene terephthalate; PBT for the polyester, polybutylene terephthalate; PE for the polyolefin, polyethylene; and PP for the polyolefin, polypropylene.

It has been surprisingly determined that, if the three requirements mentioned above are met, self-crimping of the fibers with two-dimensional Ω-bows and a controllable portion of three- dimensional spiral bows is obtained. The type of crimping is novel and extremely advantageous.

It is indeed astonishing that the method in accordance with the invention works, because up to now it was not conceivable, for purely geometric reasons alone, that self-crimping of the individual fibers could take place in a compact tow with greatly limited freedom of movement. Even more surprising is the self-crimping form created by means of the method in accordance with the invention and its mechanism. The novel way of operating, developed in the course of inventive activities on the fiber line, avoids the problems occurring when employing DE 17 60 755 (GB 1,219,154) in connection with large fiber tows.

BRIEF DESCRIPTION OF DRAWING

To explain the invention, preferred variants of the drawing and crimping method in accordance with the invention are schematically represented in FIGS. 1, 2A and 2B, wherein, in more detail.

FIG. 3, consisting of five sub-figures, show drawings made from cuttings enlarged from 100–141% size of cuttings from larger tows of self-crimped bi-component fibers according to the present invention.

DETAILED DESCRIPTION OF EMBODIMENTS

Figure 1:
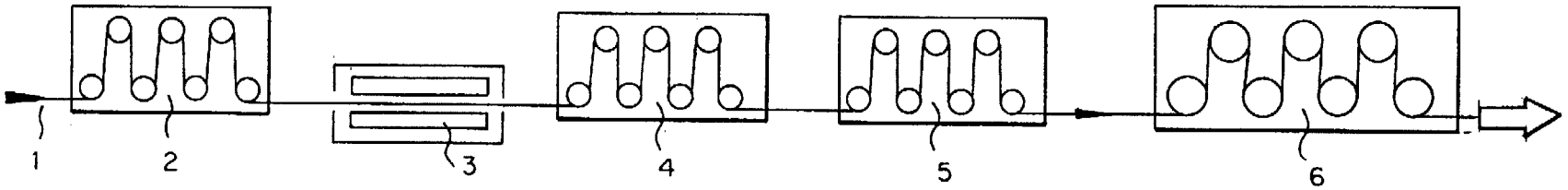
FIG. 1 shows a complete drawing device.
Figure 2A:
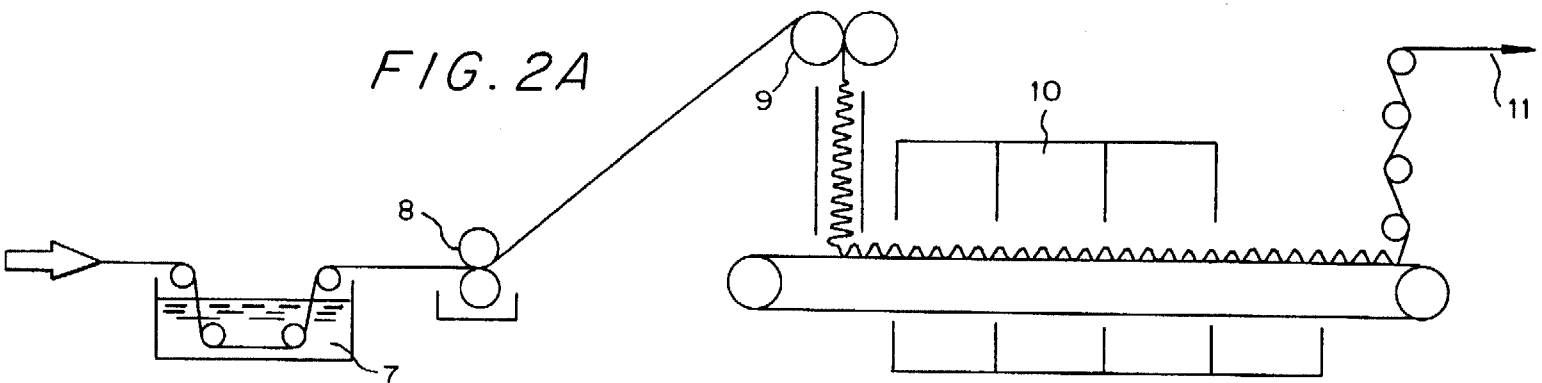
FIG. 2A shows tow finishing by an immersion bath.
Figure 2B:
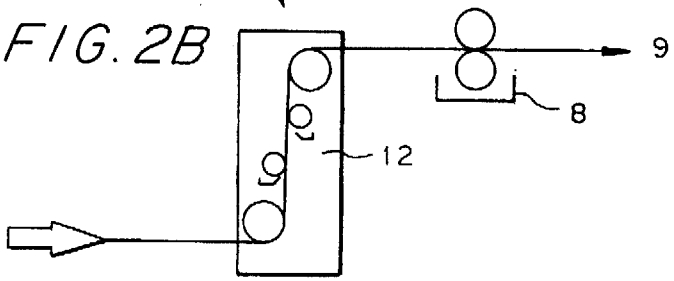
FIG. 2B shows tow finishing by rollers.

In the schematic views of a preferred system according to the present invention as illustrated in FIGS. 1, 2A and 2B, the following reference numerals correspond with the stated elements.

1 Spinning tow (undrawn S/S bi-component fiber tow)
2 First drawing unit
3 Steam channel 4 Second drawing unit
5 Third drawing unit
6 Fourth drawing drawing unit (cooling calender)
7 Immersion bath for applying the end finish
8 Squeezing rollers
9 Tow coiling device at the front of the dryer
10 Plate belt conveyor dryer
11 Finished tow to the cutting machine
12 Roller finish as an alternative to 7

An undrawn S/S bi-component fiber tow i is obtained by combining the tows from a multitude of cans, in which the combined cables from all spinning positions were respectively placed at the spinning machine. The undrawn tow is still fiat, since the crimping properties are only latent in this state. Because of higher crimping potential, bi-component cables of two different, but related-in-type (for sufficient adhesion), polymers are preferably used, for example PA 6/PA 66, PET/PBT, PE/PP or pairings of polymers and co-polymers, such as PET/co-PET. The combination of PET/ε-caprolactone-co-PET, with a lactone proportion in the co-PET between 4 and 12 mol-%, is particularly preferred in the method in accordance with the present invention.

To obtain a compact tow closure with preheating and evening out of the spinning preparation coating, the tow 1 is respectively conducted through a wetting trough (not shown) before it is run up on the first drawing unit 2. In the case of PET/co- PET, the godet temperature is set to approximately 70° C. Drawing takes place between the first and the faster running second drawing unit 4, aided by a steam channel at for example 100° C. The temperature (related to the example of polyester, as are all subsequent data) in the second drawing unit is approximately 120° C. Depending on the spinning speed and fiber type, the drawing ratio is usually in the range between approximately 1:3.0 and 1:3.7.

If, as indicated in FIG. 1, a total of four drawing units is provided, the setting values for the third drawing unit 5 are the same as for the second. If the fiber line is only equipped with a total of three drawing units, which in principle is sufficient for the method in accordance with the present invention, the third drawing unit must take over the job of the last drawing unit. It is important, however, that the fiber tow must be dry up to the last hot (approximately 120° C.) godet and must have approximately reached the godet temperature.

A small post-drawing on the cold, last (the fourth in the drawing figure) drawing unit 6 is important for inducing the crimping. Cold means not heated, i.e. approximately room temperature is used for this post-drawing. In actual use the last drawing unit often is a so-called calender, with larger godets, which with normal PET fibers is used for heat setting. The ratio of post-drawing is preferably in the range between 1:1000 and 1:1.100, and particularly preferred in the range between 1:1.005 and 1:1050.

Another treatment step important for the method in accordance with the present invention, follows the drawing process: the tow, under tension, is given a relatively high and evenly distributed water content. Simultaneously with the water application, the final finish, which with filler fibers is a silicon compound usually emulsified in water as a rule, is applied to the tow. The tow moistening is best realized by means of passage of the tensioned tow through an immersion bath 7 as schematically shown in FIG. 2A. The excess water squeezed out between the rollers 8 to such a degree that a water coating which is optimal for the present method remains on the tow. Such optimal range lies between 10% and 30% water coating, and the range between 15% and 20% is particularly preferred, based on the dry weight of the tow. This water coating is clearly higher than the range (<6%) claimed in DE 17 60 755 (GB 1,219,154).

Another advantageous variant of tow wetting is represented in FIG. 2B, a roller finish 12 (kiss rollers). This option can be employed in place of an immersion bath. Although theoretically the correct water amount should be directly adjustable by means of the roller finish, it is recommended as a rule in this case, too, to apply an excess and to squeeze it off afterwards, because only in this way is even wetting into the core interior of the tow assured.

Finally, the third and last treatment step necessary for the method in accordance with the present invention on the fiber line takes place: relaxing and self-crimping. Relaxation occurs after the roller pair of the coiling device 9. In contrast to known ways of proceeding, a characteristic and essential point of the present method is that relaxation of the tow takes place in a wet and compact closed state, and the tow is not opened, so that the individual fibers in a compact structure touch each other and have a certain amount of adhesion to each other.

It is surprising that self-crimping can occur under these conditions, which differ greatly from the conditions taught and used in the prior art. The self-crimping of the fibers already starts in the manifold of the coiling device 9 at the inlet to the plate belt conveyor dryer 10. The manifold is used to coil the tow in a snake-like manner over the width of the plate belt conveyor dryer. With close coiling (for using the dryer capacity) it is optionally possible to use additional auxiliary devices between the end of the manifold and the plate belt in order to ensure coiling free of twisting and overlays. Crimping occurs to a great extent already prior to entering the first drying chamber. Due to the way of operation in accordance with the present invention, the tow is still far less voluminous even in the crimped state than an opened blown-up tow, and so it can still be manipulated without problems. The plate belt conveyor dryer 10 is preferably set to a temperature in the range between 145° and 185° C. and a residence time between 5 and 12 minutes, preferably approximately 7.5 minutes.

It is also possible to employ a screen cylinder dryer in place of a plate belt conveyor dryer. The drying conditions are required for curing the silicon finish on the fiber surface and at the same time are used for drying and heat setting the crimped tow. The finished crimped tow is cooled at the end of the plate belt and is then as a rule supplied to a cutting machine (not shown) at position 11 downstream from cooling. However, there are also applications in which the uncut tow is further processed.

A novel type of crimping is surprisingly formed with the procedure in accordance with the present invention for producing self-crimping fiber cables, yarns or tows, which no longer is in the form of spirals or helical lines as occurs with the conventional methods. We have called the novel crimping Omega (Ω) crimping. That this is the fitting description can be seen in the characteristic pattern b. seen in FIG. 3, it being noted that all illustrations in FIG. 3 have been enlarged by 141% in order to make the crimping structure better visible. Up to now, such nicely round and regular crimping bows of a similar type could only be produced by means of a complicated mechanical method, sometimes called crinkle method or knit crimping such as described for example by R. Bauer and H. J. Koslowski in Chemiefaser-Lexikon [Dictionary of Chemical Fibers], Deutscher Fachverlag GmbH, Frankfurt/Main, 1979, bottom of page 60 (illustration) and right bottom of page 63, or by B. von Falkai in Synthesefasern [Synthetic Fibers], Verlag Chemie, Weinheim 1981, bottom of page 148 and page 149 (Ill. 20 with photograph).

But the Ω-bows in the pure form provided in accordance with the invention are not produced isolated in individual fibers or groups of fibers, but instead in a compact, larger structure under suitable conditions. This becomes clear when considering FIG. 3*a*, which represents a planar section of an Ω-crimped fiber tow in accordance with the present invention. Viewed from above, a regular continuous wave structure of strict order can be seen, which continues with a constant phase exactly phase-synchronously in the running direction of the tow (left-right) and surprisingly also laterally (top-bottom). This highly ordered structure was formed on its own under the selected conditions, which at first seem almost unbelievable if mechanical knit crimping is considered.

Figure 3A:
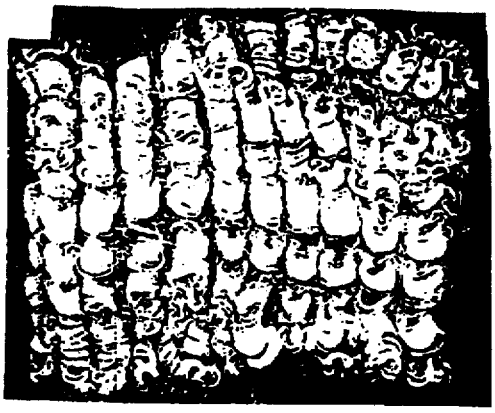
FIG. 3*a* is a planar section of an omega-crimped fiber tow according to the present invention.
Figure 3B:
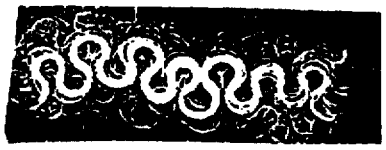
FIG. 3*b* is a longitudinal profile of FIG. 3*a*.

The individual fibers with Ω-crimping are again found if a longitudinal section is made through the planar piece of FIG. 3*a* and viewed from the side, i.e. FIG. 3*b* represents the longitudinal profile of FIG. 3*a*. With this in view, it is also indirectly apparent that the pure real Ω-crimping is a two-dimensional (planar) crimping.

Figure 5:
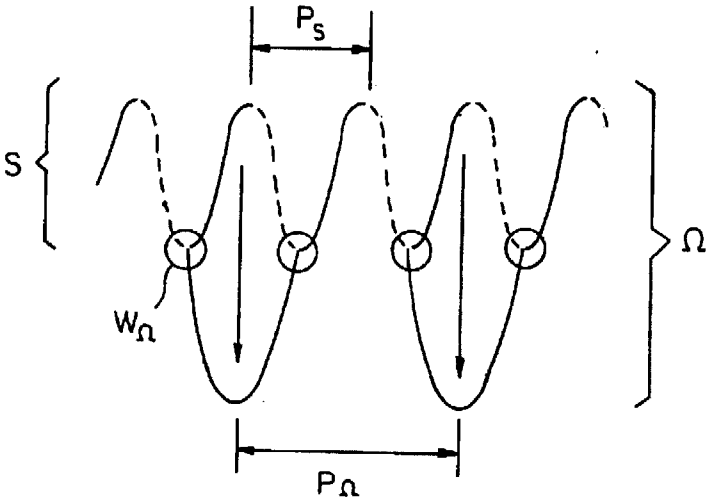
FIGS. 4 and 5 are schematic drawings comparing known spiral crimping with novel Ω(omega) crimping according to the present invention.
Figure 4:
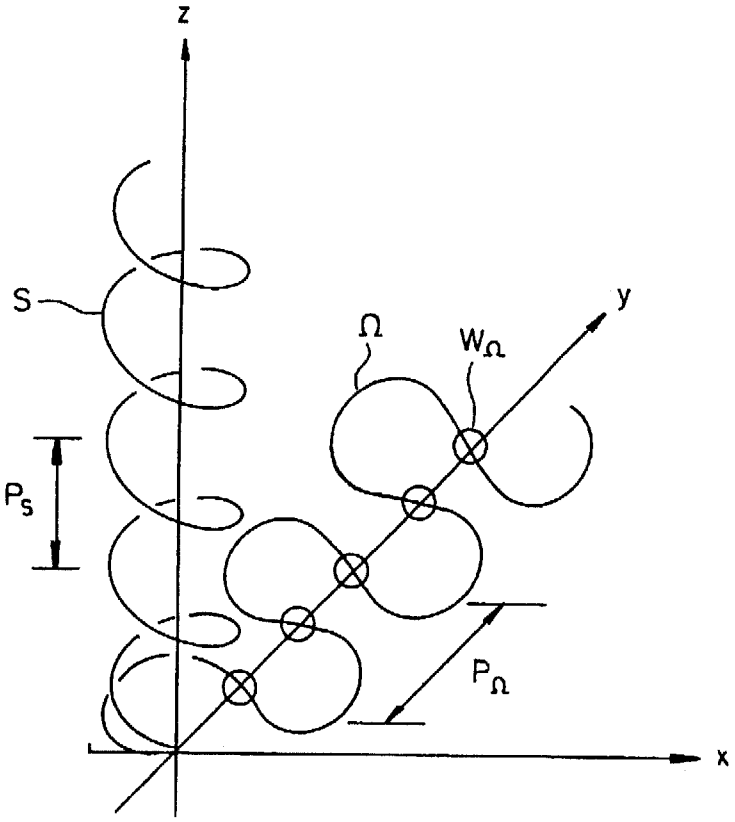

The geometry of the known spiral crimping and of the novel Ω-crimping in accordance with the invention are compared with each other in FIGS. 4 and 5. The symbols have the following meaning:

| | |
|---|---|
| x, y, z | Axes of a three-dimensional coordinate-system |
| S | Spiral crimping |
| Ω | Omega crimping |
| $P_s$ | Period of the spiral crimping |
| $P_\Omega$ | Period of the Omega crimping |
| $W_\Omega$ | Turning point of the Omega crimping |

Starting at the coordinate zero point, the spiral crimping of a fiber in the direction of the z-axis vertically upward is represented in FIG. 4, the Ω-crimping in the x, y-plane in the y-direction. With each type of self-crimping the component of the S/S bi-component configuration which shrinks more (in the case of PET/co-PET the copolyester) is respectively located on the inside of the crimping bows. Since in contrast to spiral crimping the Ω-crimping has alternatingly bows of opposite directions of turning, the mathematical turning points of the Ω-curve path (intersections with the y-axis) also simultaneously correspond to material turning points with an exchange of the components position in the fiber. Since this position change of course takes place continuously, it can only take place, given the steric (lateral) hindrance in the tow structure, in such a way that the fibers turn around their own axes when making the transition from one Ω-bow to the next. Because of the mutual contact, this turning does not take place individually, but coupled over the entire connected tow width in such a way that adjoining fibers respectively roll off on each other in opposite directions of rotation (alternatingly back and forth after every bow). The turning points of the Ω-crimping are therefore the communication system of the compact tow, so to speak, by means of which the synchronization of the crimping takes place which, in the end, results in the self-organization and the high degree of order of the tow.

In FIG. 5 it is shown why the same material has automatically larger bows, i.e. a longer crimping period or fewer bows per linear unit, in the Ω-crimping form than the S-crimping form. If the two crimping types are drawn in linear profile partially congruently on top of each other, it can be seen that an S-bow is already finished when the Ω-bow has only traveled half the length to the turning point and still swings out to the other side. However, the Ω-period need not be exactly twice as wide as the S-period (this also depends on the effective pitch of the S-spiral line), but generally larger bows (in period and amplitude) always result in the Ω-crimping form than in the spiral form.

For certain applications neither the pure S-crimping nor the pure Ω-crimping is optimal. However, by means of the method in accordance with the present invention it is possible without any disadvantages in the production process to specifically set advantageous intermediate stages between the Ω- and the S- crimping. In FIG. 4 such fibers would be located in the y, z- plane and would extend in places in an Ω-shape in the y-direction and then again in places in an S-shape in the z-direction. Patterns of such no longer pure Ω-crimpings, shot through with spiral bows, are represented in FIGS. 3*d* and *e*. The pattern of FIG. 3*d* shows an intermediate crimping shape suitable for the production of fill fibers, but particularly also for small fiber spheres for example Schlafkugetn®(or "dream balls ®") which has particularly advantageous bulking and resilience properties in the hollow embodiment. A preferred application for pure, two- dimensional Ω-crimping are fibers crimped in this way (not hollow) for the reinforcement of special paper (wet fleece).

The production requirements of the patterns in FIGS. 3*c* to *e* will be discussed in more detail in the following example.

EXAMPLE

Undrawn bi-component spinning material of the composition PET/Ω-caprolactone-co-PET with 8 mol-% of the caprolactone portion in the co-PET and of the S/S hollow cross- sectional configuration was the basis.

Figure 3C:
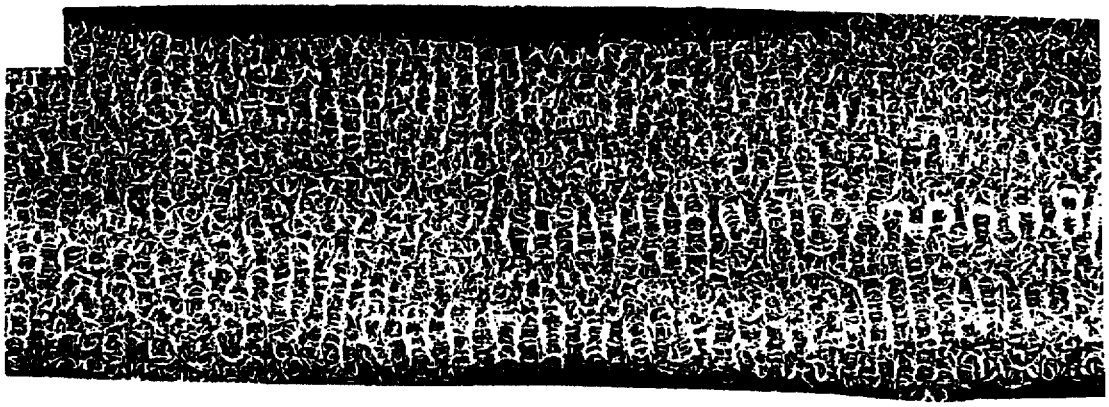
FIG. 3*c* is a tow made by omega-crimping by a post-drawing ratio of 1:1.006 and immersion/squeezing finishing.
Figure 3D:
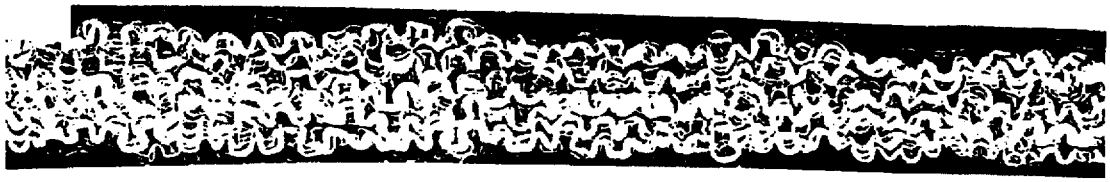
FIG. 3*d* is an omega-crimped tow altering with S-crimping by a post-drawing ratio of 1:1.006 and (metered) roller finishing.

The main drawing ratio between the first and the second drawing unit was approximately 1:3.5. The way of application of the (5%) silicon finish and the post-drawing ratio to the cold drawing unit were varied, both of which had an effect on the self- crimping. The textile data of the individual fibers remained approximately the same in these variations, i.e. the result for the finished fibers was a titer of approximately 5.3 dtex, a breaking elongation of approximately 45% and a tensile strength of approximately 3.6 cN/dtex. The variations had the following effects regarding the crimping geometry:

With a post-drawing ratio of 1:1.006 with subsequent immersion and squeezing, a nice Ω-crimping resulted, as can be seen on the (loosened) tow piece of FIG. 3*c*.

With the same post-drawing ratio (1:1.006), but with (metered) roller finish without squeezing, the crimping in FIG. 3*d* resulted. Because of the uneveness in the water coating, smaller fiber groupings were formed, in which Ω- and S-bows alternate statistically.

With finishing by means of immersion and squeezing, but with a previously increased higher post-drawing, a displacement from the Ω- to the S-crimping also occurred.

Figure 3E:
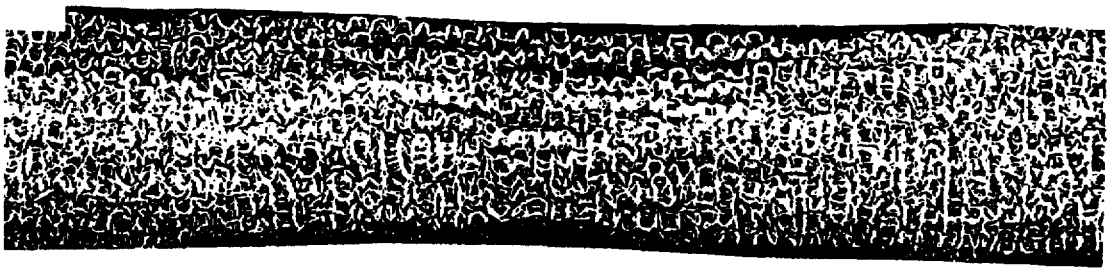
FIG. 3*e* is an omega-crimped tow alternating with S-crimping by a post-drawing ratio of 1:1.024 and immersion/squeezing finishing.

With the pattern in FIG. 3*e* the post-drawing proportion was 1:1.024. With even greater post- drawing (1:1.050 and more), a formation of individual strands occurred which had more S-than Ω-crimping. The higher the post-drawing, the finer the crimping of the Ω-areas, which can be seen in the comparison of FIGS. 3*c* and *e*.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. In a method for producing self-crimped bi-component fibers from a tow of bi-component fibers which have been side-by-side spun from bi-component material, comprising drawing said tow to provide a drawn tow; optionally finishing said drawn tow; then relaxing the drawn and optionally finished tow to provide a relaxed tow; drying and heat setting said, relaxed tow to provide a heat-set tow; and optionally cutting said heat-set tow; the improvement further comprising post-drawing said drawn tow prior to said optional finishing and said relaxing said post-drawing being carried out in a hot and dry state on a cold drawing unit;

after said post-drawing with said tow being in a tensed state, prior to said relaxing, providing said post-drawn tow with a water coating of between 10 and 30 weight percent, measured prior to relaxation, to provide a water-coated tow;

carrying out said drying of said water-coated tow in a dryer having an inlet; and carrying out said relaxing of said water-coated tow at the inlet of said dryer while said water-coated tow is in a compact, closed state to provide bi-component fibers having two-dimensional Ω-crimped bows.

2. A method in accordance with claim 1, wherein a drawing ratio of maximally 1:100 is used forsaid post-drawing.

3. A method in accordance with claim 1, wherein a drawing ratio of between 1:005 and 1:050 is used for post-drawing.

4. A method in accordance with claim 1, wherein finishing is performed by immersion or roller finishing.

5. A method in accordance with claim 1 wherein said optional finishing is carried out and comprises applying a silicon finish to said post-drawn tow.

6. A method in accordance with claim 1, wherein said water coating is 15 to 20 weight %.

7. A method in accordance with claim 1, wherein said bi-component fiber comprises two related polymers-selected from the group consisting of PA 6/PA 66, PET/PBT, PE/PP, PET/co-PET.

8. A method in accordance with claim 7, wherein said bi-component fiber is PET/co-PET.

9. A method in accordance with claim 8, wherein said co-PET comprises 4–12 mol % of randomly distributed Ω-caprolactone.

10. A method in accordance with claim 2, wherein said water coating is 15 to 20 weight %.

11. Endless or cut self-crimped bi-component fibers comprising at least 30% of two-dimensional Ω-crimped bows, producible according to the method of claim 1.

12. Endless or cut self-crimped bi-component fibers according to claim 11 comprising at least 60% of said two-dimensional Ω-crimped bows.

13. Endless or cut self-crimped bi-component fibers comprising at least 30% of two-dimensional Ω-crimped bows, producible according to the method of claim 2.

14. Endless or cut self-crimped bi-component fibers according to claim 13 comprising at least 60% of said two-dimensional Ω-crimped bows.

15. Endless or cut self-crimped bi-component fibers comprising at least 30% of two-dimensional Ω-crimped bows, producible according to the method of claim 10.

16. Endless or cut self-crimped bi-component fibers according to claim 15 comprising at least 60% of said two-dimensional Ω-crimped bows.

17. A method for producing self-crimped polymer bi-component fibers having at least partially two-dimensionally Ω-crimped bows from spun self-crimpable bi-component fibers in a fiber tow, comprising drawing said tow on a device comprising plural hot drawing rollers to provide a drawn tow;

post-drawing said drawn tow on a cold drawing unit to produce a post-drawn tow;

applying a water coating of between 10 and 30 weight percent to said post-drawn tow and to provide a water-coated tow;

relaxing said water-coated tow at an inlet of a dryer to provide a relaxed tow;

drying and heat setting said relaxed tow to provide a heat-set tow; and optionally cutting said heat-set tow.

* * * * *

UNITED STATES PATENT AND TRADEMARK OFFICE

CERTIFICATE OF CORRECTION

PATENT NO. : 5,701,644

DATED : Dec. 30, 1997

INVENTOR(S) : Werner Kaegi et al.

It is certified that error appears in the above-identified patent and that said Letters Patent is hereby corrected as shown below:

Column 6, line 19, delete "Schlafkugetn" and insert therefor --Schlafkugeln--;

Column 8, line 9 (Claim 9, line 3), delete "Ω" and insert therefor --ε--.

Signed and Sealed this

Twelfth Day of May, 1998

Bruce Lehman

*Attest:*

BRUCE LEHMAN

*Attesting Officer*

*Commissioner of Patents and Trademarks*